US010059488B2

(12) United States Patent
Chiriga

(10) Patent No.: US 10,059,488 B2
(45) Date of Patent: Aug. 28, 2018

(54) BEVERAGE CONTAINER

(71) Applicant: Tigere Chiriga, Mooresville, NC (US)

(72) Inventor: Tigere Chiriga, Mooresville, NC (US)

( * ) Notice: Subject to any disclaimer, the term of this patent is extended or adjusted under 35 U.S.C. 154(b) by 54 days.

(21) Appl. No.: 15/121,066

(22) PCT Filed: Feb. 27, 2015

(86) PCT No.: PCT/GB2015/050589
§ 371 (c)(1),
(2) Date: Aug. 24, 2016

(87) PCT Pub. No.: WO2015/128675
PCT Pub. Date: Sep. 3, 2015

(65) Prior Publication Data

US 2016/0360910 A1 Dec. 15, 2016

(30) Foreign Application Priority Data

Feb. 27, 2014 (GB) ..... 1403486.2

(51) Int. Cl.
*B65D 23/06* (2006.01)
*A47G 23/02* (2006.01)
*A47G 19/22* (2006.01)

(52) U.S. Cl.
CPC ..... *B65D 23/065* (2013.01); *A47G 19/2205* (2013.01); *A47G 19/2255* (2013.01); *A47G 19/2261* (2013.01); *A47G 23/0216* (2013.01); *B65D 23/06* (2013.01)

(58) Field of Classification Search
CPC ... B65D 23/06; B65D 23/065; A47G 23/0216
USPC ..... 215/393, 392
See application file for complete search history.

(56) References Cited

U.S. PATENT DOCUMENTS 166,350 A * 8/1875 Dodge ..... A47G 19/2205 215/374
2,158,230 A * 5/1939 Godfrey ..... A47G 19/2205 215/372
2,655,281 A * 10/1953 Davis ..... A47G 23/03 215/394
4,872,569 A 10/1989 Bolte
5,273,182 A * 12/1993 Laybourne ..... A47G 23/03 215/228

(Continued)

FOREIGN PATENT DOCUMENTS

DE 137481 C 12/1902
FR 860414 A 1/1941

(Continued)

*Primary Examiner* — Jeffrey Allen
*Assistant Examiner* — Jennifer Castriotta
(74) *Attorney, Agent, or Firm* — Nasser Ashgriz; UIPatent Inc.

(57) ABSTRACT

A beverage container for preventing or inhibiting moisture collection on a lower surface thereof the beverage container comprising a liquid receptacle portion for containing a beverage, the liquid receptacle portion having inner and external surfaces defined by at least one upstanding wall and a base; a support portion disposed below the base of the liquid receptacle portion; and a liquid collection device interposed between the liquid receptacle portion and the support portion for in-use collecting excess liquid present on the external surface of the liquid receptacle portion.

12 Claims, 4 Drawing Sheets

(56) References Cited

U.S. PATENT DOCUMENTS

| | | | | |
|---|---|---|---|---|
| 7,530,468 | B1 | 5/2009 | Garvey | |
| 2005/0269474 | A1 | 12/2005 | Kazyaka | |
| 2006/0019060 | A1* | 1/2006 | Heldibridle | A47G 23/0216 428/102 |
| 2006/0081750 | A1* | 4/2006 | Kazyaka | A47G 23/0225 248/311.2 |
| 2007/0131834 | A1* | 6/2007 | Reid | A47G 23/0216 248/346.11 |
| 2009/0114791 | A1* | 5/2009 | Alger | F25D 3/08 248/346.11 |
| 2011/0114812 | A1* | 5/2011 | an Goolen | A47G 23/03 248/346.03 |
| 2013/0167868 | A1* | 7/2013 | Brewer | G09F 3/06 134/6 |
| 2015/0173544 | A1* | 6/2015 | Sayarh | A47G 23/03 220/737 |

FOREIGN PATENT DOCUMENTS

| | | | |
|---|---|---|---|
| JP | H01 151770 | U | 10/1989 |
| JP | H05 86268 | U | 11/1993 |
| JP | H09 301374 | A | 11/1997 |

* cited by examiner

BEVERAGE CONTAINER

RELATED APPLICATIONS

The present application is a U.S. National Phase Application under 35 U.S.C. § 371 of International Patent Application No. PCT/GB2015/050589 filed Feb. 27, 2015 and claims the benefit of UK Patent Application No. GB1403486.2 filed on Feb. 27, 2014 all of which are hereby incorporated by reference in their entireties.

BACKGROUND OF THE INVENTION

The present invention relates to a beverage container, and more particularly but not necessarily exclusively to a drinking vessel, for preventing or inhibiting moisture collection on a lower surface of the container. More particularly but not necessarily exclusively, the beverage container is a glass or tumbler having a releasable liquid collection device for collecting drips or moisture which forms on an outer surface thereof.

When using a tumbler, glass or other generally straight- or round-sided beverage container, because the rim is generally rounded so as not to provide a sharp surface on which the drinker can cut their mouth, drips are readily formed on the external surface of the vessel. The external surfaces of such beverage containers are smooth, being typically constructed from glass, and the drips rapidly run down the sides to collect on a lower surface or base of the vessel.

Even if the drinker is careful in avoiding spillage, if the beverage being consumed is cool enough, for instance, if it contains ice, then condensation can form on the external surface of the beverage container. This condensation can readily accumulate into drips, running down the external surfaces of the beverage container.

The majority of furniture items are not liquid-resistant; therefore, if the beverage container is put onto such a piece of furniture, the accumulated liquid may cause watermarking or other damaging stains to the furniture's surface. This can cause irreversible damage to the furniture, in addition to leaving obvious and unsightly markings.

Presently, coasters are used to combat this problem, being intermediate, liquid-resistant items which can be interposed between the beverage container and the furniture. However, there are several disadvantages to coasters. For instance, they are easily forgotten, meaning that the beverage container may be put onto the furniture regardless of the presence of a coaster. Additionally, the level of a coaster will be slightly above that of the underlying surface, meaning that the beverage container can be more easily knocked over, if, for instance, the beverage container were not located centrally onto the coaster. Furthermore, accumulated condensate on a base of the vessel can cause a coaster to adhere, being unintentionally picked up with the beverage container and consequently dropping off at an inopportune moment.

SUMMARY OF THE INVENTION

It is an object of the invention to provide a beverage container which can prevent the build-up of moisture on its lowermost surface, and more particularly its base, to substantially mitigate or reduce the above problems.

According to a first aspect of the present invention there is provided a beverage container for preventing or limiting moisture collection on a lower surface thereof the beverage container comprising: a liquid receptacle portion for containing a beverage, the liquid receptacle portion having inner and external surfaces defined by at least one upstanding wall and a base; a support portion disposed below the base of the liquid receptacle portion; and a liquid collection device interposed between the liquid receptacle portion and the support portion for in-use collecting excess liquid present on the external surface of the liquid receptacle portion. The upper surface of the liquid collection device may be downwardly sloped in an inward direction for preventing or limiting spillage during tilting of the beverage container.

The introduction of a liquid collection device for excess liquid to drain into prevents the excess liquid from collecting on a lower surface or base of the beverage container. This can therefore eliminate the need for a coaster when drinking a cold beverage. As such, the container is more stable on the surface onto which it is placed, without leaving a stain or watermark.

Preferably, the liquid collection device defines at least in part an excess liquid reservoir into which exterior excess liquid is directable by the liquid collection device.

Such an excess liquid reservoir is used to capture the excess liquid which forms on the external surface of the beverage container. Having a reservoir, rather than an absorbent element, for instance, allows for straightforward draining of the collected liquid, thereby allowing the user an opportunity to remove the liquid before it overflows from the reservoir. The liquid reservoir is a preferable feature, and in some instances may be dispensed with or supplemented by a different or additional liquid collector, such as an absorbent element, for example, a sponge ring, tube or annulus, or indeed a fabric liquid retaining device.

Preferably, the liquid receptacle portion may be defined by at least a single upstanding cylindrical wall and the base.

Glassware is typically used for beverage containers. As glass is a smooth, liquid-impermeable material, moisture which collects on the outside will quickly run down the external surface to collect on the lower surface of the container or run off a lowermost perimeter edge. The present invention can replace such glassware, being typically formed as a tumbler having a cylindrical upright wall and a base adjoined by a stem. Other kinds of beverage container can also be considered, such as a decanter, bottle and carafe. Additionally or alternatively, the container may be provided with a lid or cover, which may be screw-threaded or snap-fit. Other materials in addition to glass may be considered, such as plastics, pottery and/or ceramics.

Preferably, a lower region of the external surface of the liquid receptacle portion may be at least in part frusto-conical or substantially frusto-conical.

Since moisture is prone to running down the external surface of glassware, it is advantageous to direct the moisture to the liquid collection device. This prevents moisture droplets forming on the external surface and dripping or running onto the furniture item, bypassing the liquid collection device.

Preferably, the liquid receptacle portion may be attached to the support portion by a stem. Preferably still, the liquid receptacle portion, stem and support portion may be integrally formed with one another. Alternatively, the stem may be releasably attachable to the support portion, thereby allowing the base to be disengaged.

A core portion of the beverage container, that is, the liquid receptacle and support portions, advantageously includes the interconnecting stem, thereby providing an area into which the liquid collection device can be positioned below the liquid receptacle portion. The core portion may be integrally formed, for ease of construction and overall stability, or may be provided so that the liquid receptacle and support portions are detachable from one another, which may make the attachment of the liquid collection device more straightforward.

Preferably, the liquid collection device may be releasably attachable to the support portion of the beverage container, the excess liquid reservoir being formed by an inner surface of the liquid collection device, an upper surface of the support portion, and an outer surface of the stem. Further preferably, the support portion may include a stepped portion for engaging with the liquid collection device. Preferably, the liquid collection device may include at least one sealing projection for forming a watertight seal for the excess liquid reservoir with the support portion.

By providing a releasable liquid collection device, a watertight excess liquid reservoir can be created, and the contained liquid released without having to tilt or invert the beverage container.

Preferably, the liquid collection device may include an aperture sized to allow the support portion to pass therethrough. Preferably, the liquid collection device may be formed from a resiliently flexible material. In this case, the material is elastic, allowing the liquid collection device to be stretched over the support portion and seated on a stepped upper portion thereof.

By providing the liquid collection device as a continuously annular unit, it can be attached to the core portion of the beverage container by passing over the support portion. This means that the liquid collection device can be constructed to be releasable, without having to provide joins or seams which may prove to have a deleterious effect upon the watertightness of the excess liquid reservoir which is formed by the liquid collection device. By constructing the liquid collection device from a resiliently flexible material, such as silicone or an elastomer, it can be stretched over the support portion, whilst retaining its tight-fitting shape.

Preferably, an upper surface of the liquid collection device may be angled towards a receiving aperture of the excess liquid reservoir. Preferably, the upper surface of the liquid collection device may include at least one flute for improving drainage. The flute has a predetermined radially-inwardly extending fall for the runoff of condensate or other kinds of drip.

The provision of a fluted, downwardly sloping upper surface of the liquid collection device beneficially directs any drips which form on or fall onto the liquid collection device towards the aperture, and therefore the excess liquid reservoir. A further advantage of the downwardly dependent upper surface is that an overhang is formed whereby, when the beverage container is tilted, any liquid contained within the excess liquid reservoir is retained at normal tilted drinking angles, rather than spilling onto the user.

Preferably, the upper surface of the liquid collection device may include at least one baffle extending towards the support portion for further preventing or limiting spillage during tilting of the container. The baffle adds additional protection against spillage of the liquid out of the liquid collection device.

Preferably, the liquid receptacle portion and support portion may have identical or substantially identical circumferential extents along at least a majority of their axial extents. Still preferably, the liquid collection device may have an identical or substantially identical circumferential extent to that of the liquid containment and support portions. Preferably, an outer surface of the liquid collection device may be flush or substantially flush with the external surface of the liquid receptacle portion.

Providing the beverage container with a substantially uniform profile along its longitudinal extent will both improve the aesthetic appearance of the container, whilst also making the container easy to handle, akin to a standard tumbler. However, other shapes of beverage container can be envisaged utilising the liquid collection device, such as a stemmed wine glass or champagne flute. In these latter examples, the stem may be configured with two or more portions, wherein one stem portion provides the appearance of a more traditional glass stem whilst the second stem portion facilitates the inclusion of the liquid collection device.

Preferably, the support portion may include at least one weight for stability. Also preferably, the support portion may further comprise one or more feet formed of a material having a higher coefficient of friction than that of the liquid receptacle portion.

Stability is an issue for any beverage container; if the container is tipped over, the beverage will be spilt. By providing a specific support portion of the beverage container, a weight can beneficially be included or integrally formed with the support portion, lowering the centre-of-gravity of the container, thereby stabilising it. A plurality of non-slip feet may additionally or alternatively be included with the support portion to provide a further frictional force on the surface upon which the beverage container is resting, thereby further resisting spillage.

Preferably, the liquid receptacle portion may be formed from glass. Alternatively, the liquid receptacle portion may be formed from plastics, earthenware, ceramic or pottery.

The liquid receptacle portion is ideally designed to appear similar to a standard tumbler or other known glass beverage container. Therefore, the container is preferably formed from glass, or a transparent plastic material. This allows the present invention to be integrated into an existing collection of beverage containers without being obviously dissimilar.

According to a second aspect of the invention, there is provided a beverage container for inhibiting moisture collection on a lower surface of the container comprising: a cylindrical liquid receptacle portion for containing a consumable liquid, the liquid receptacle portion having inner and external surfaces defined by a cylindrical upstanding wall and a base; a cylindrical support portion, connected to the cylindrical liquid receptacle portion via a cylindrical stem; a releasably engagable cylindrical liquid collection unit including a central aperture; and an excess liquid reservoir; wherein the liquid collection unit is interposable between the liquid containment and support portions, the liquid collection unit watertightly engaging with a stepped portion of the support portion, and the excess liquid reservoir being formed by an inner surface of the liquid collection unit, an upper surface of the support portion and an outer surface of the stem.

This beverage container is advantageously a version of the standard or traditional tumbler, typically for containing around 250 to 330 ml of liquid, having a cylindrical profile so as to make the container both easy to grip, and pleasant to drink from. The liquid containment unit traps moisture drips or spillages from the side of the container, which can be released by stretching or releasing a seal of the liquid containment unit.

According to a third aspect of the invention, there is provided a method of preventing or limiting moisture collection on a lower surface of a beverage container, comprising the steps of: a] watertightly attaching a liquid collection device to a beverage container according to the first aspect of the invention, thereby forming an excess liquid reservoir;

b] allowing moisture on an external surface of the beverage container to drip onto an upper surface of the liquid collection device; and c] draining the liquid collected on the upper surface into the excess liquid reservoir.

Preferably, the method may further comprise a step d] of releasing the liquid collection device to discharge the excess liquid collected in the excess liquid reservoir.

It is advantageous to trap the moisture or spillage running down the side of a beverage container, since allowing it to collect on a lower surface of the container may result in staining of the surface upon which the beverage container has been placed.

BRIEF DESCRIPTION OF DRAWINGS

The invention will now be more particularly described, by way of example only, with reference to the accompanying drawings, in which.

DETAILED DESCRIPTION OF THE DRAWINGS

Figure 1:
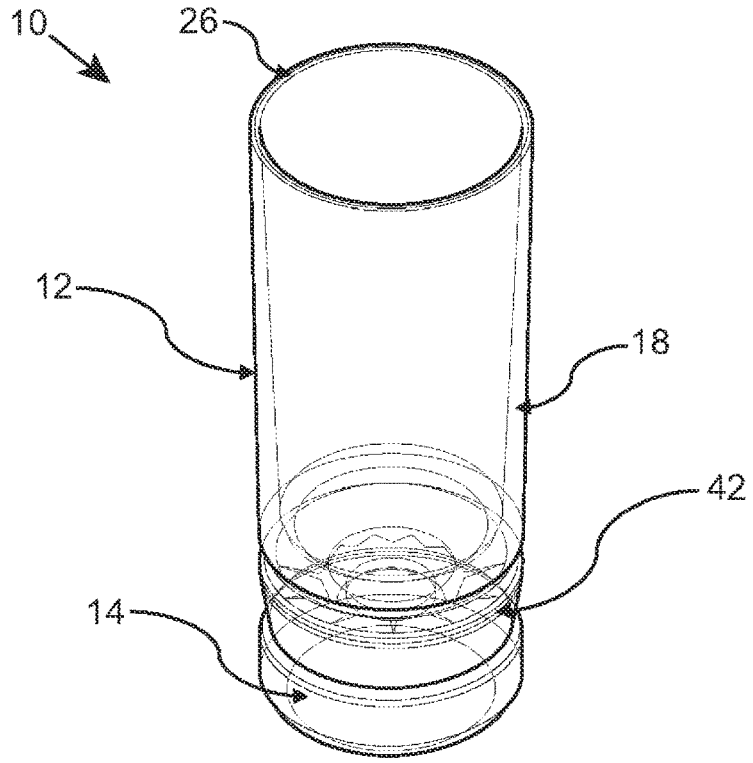
FIG. 1 shows a front perspective view of a first embodiment of a, preferably transparent, beverage container, in accordance with the present invention.
Figure 2:
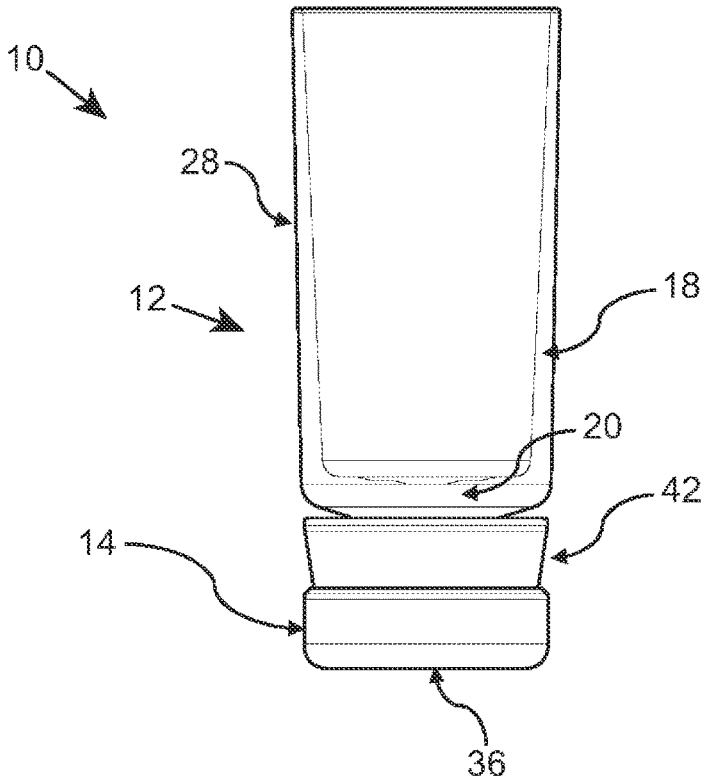
FIG. 2 shows a side view of the beverage container as shown in FIG. 1.

Referring to FIGS. 1 to 5, there is shown a beverage container 10 comprising an upper liquid receptacle portion 12, a lower support portion 14 and a stem 16 interconnecting the liquid receptacle portion 12 and support portion 14. In the present embodiment, the beverage container 10 is substantially cylindrical, the stem 16 having a smaller radial extent than either of the liquid receptacle portion 12 and support portion 14.

The liquid receptacle portion 12 comprises a cylindrical upstanding wall 18 and a base 20 defining a contiguous inner surface 22 which defines a void or volume 24 into which liquid can be contained. The void or volume 24 is unbounded at its upper end, thereby forming a rim 26, and liquid can be inserted or removed from the liquid receptacle portion 12 therefrom. The rim 26 is preferably substantially rounded to remove any sharp edges which may come into contact with a user's mouth, and also to avoid sharp edges which may enable drip formation The rim 26 merges seamlessly into the external surface 28 of the liquid receptacle portion 12. The external surface 28 of the liquid receptacle portion 12 is formed from the outer surfaces of the upstanding wall 18 and the base 20. Where the upstanding wall 18 joins the base 20, the external surface 28 is substantially rounded.

The base 20 is not of uniform thickness, in this case, and as such the external surface 28 of the liquid receptacle portion 12 is substantially frusto-conical prior to merging smoothly into the external surface 30 of the stem 16.

Below the stem 16 is positioned the support portion 14, which has an identical or substantially similar radial extent as that of the liquid receptacle portion 12. In contrast with the liquid receptacle portion 12, the support portion 14 is preferably solid, adding to an overall weight and lowering the centre of gravity of the beverage container 10. The support portion 14 may include a separate weight to improve the stability of the container 10. One or more feet may also be included, preferably of a higher coefficient of friction material compared to that of the liquid receptacle portion 12, being for example rubber or an elastomer, to also improve stability.

The support portion 14 in this embodiment has a flat upper surface 32 which extends radially from the base of the stem 16, a substantially cylindrical side surface 34 which depends from upper surface 32, and a flat or substantially flat base 36, allowing the beverage container 10 to be stably positioned on a level surface. A chamfer extends around a lowermost perimeter edge, interposed between the base 36 and the side surface 34.

Figure 3:
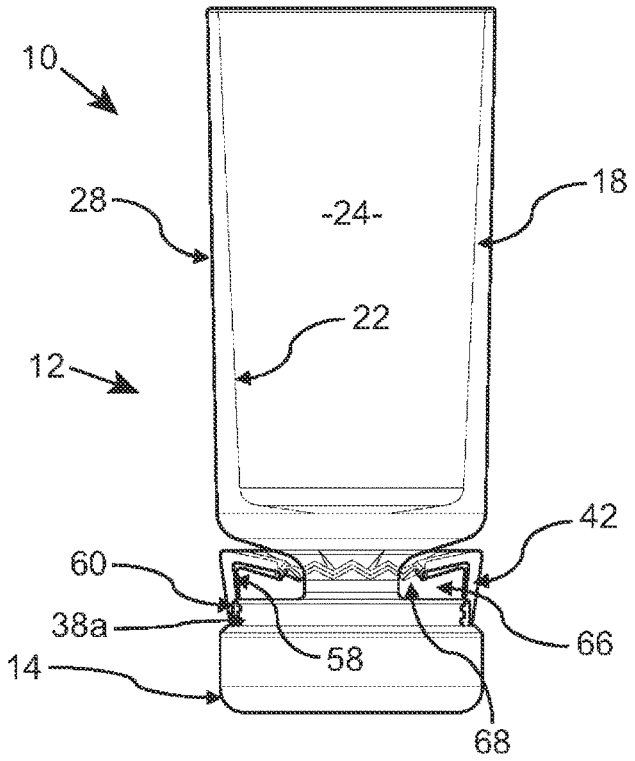
FIG. 3 shows a side cross-sectional view of the beverage container.

The side surface 34 preferably further includes a stepped portion 38 which extends around the entirety of the support portion 14, at or adjacent to the upper surface 32. As best shown in FIG. 3, the stepped portion 38 may include one or more circumferentially extending ribs or ridges **38*a* forming part of a liquid-tight sealing means. Each rib or ridge 38*a*** is endless, to prevent or limit a leak path.

Figure 4:
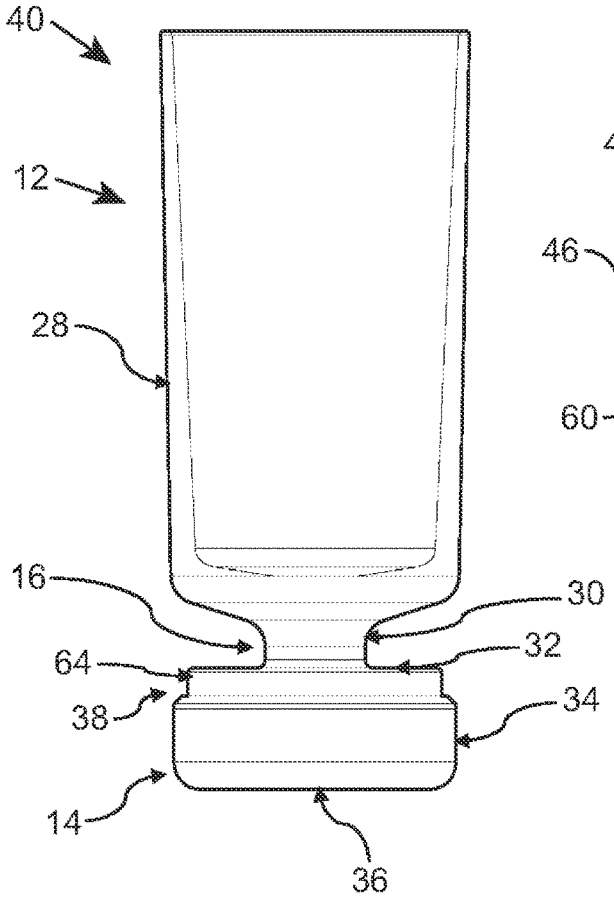
FIG. 4 shows a side view of a core portion of the beverage container.

The liquid receptacle portion 12, the support portion 14 and the stem 16 are supplied as an integrally formed unit, hereto referred to as the core portion 40 and shown specifically in FIG. 4, constructed from a transparent material, such as glass or plastics.

Figure 5:
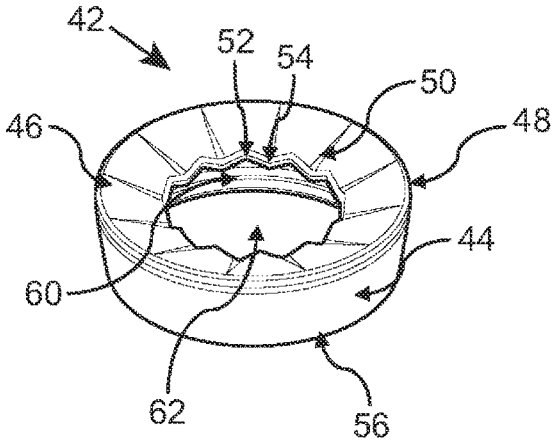
FIG. 5 shows a perspective view of one example of the liquid collection device of the beverage container.
Figure 6:
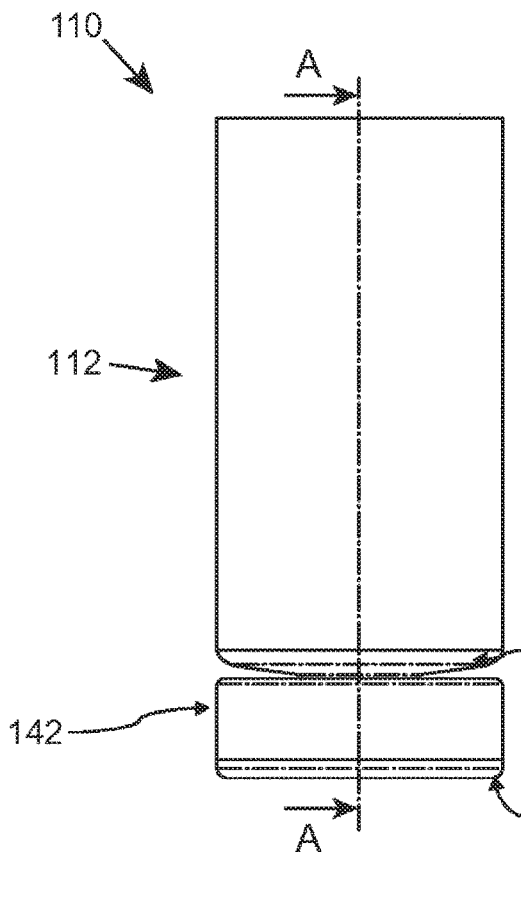
FIG. 6 shows a front view of a second embodiment of a beverage container, in accordance with the present invention.
Figure 7:
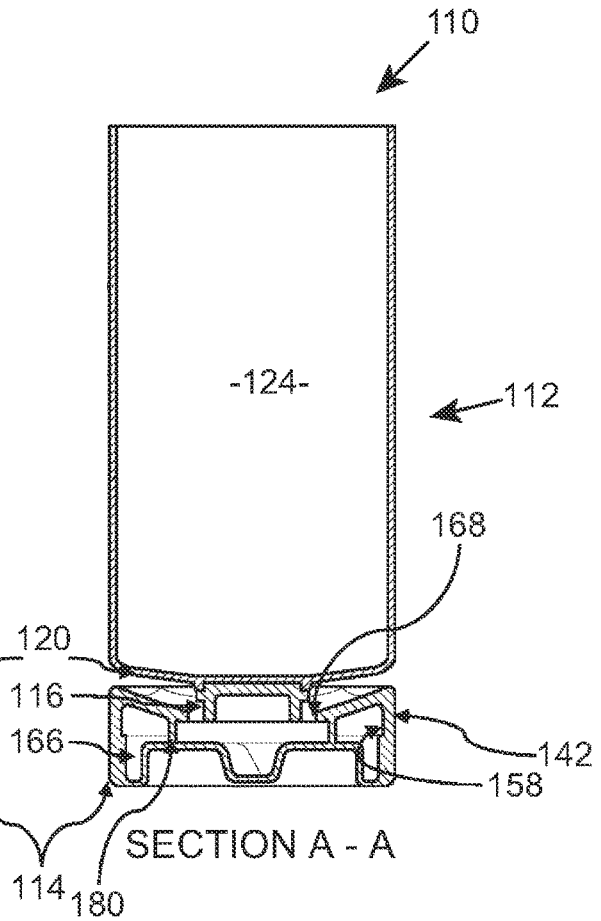
FIG. 7 shows a side cross-sectional view of the beverage container as shown in FIG. 6.
Figure 8:
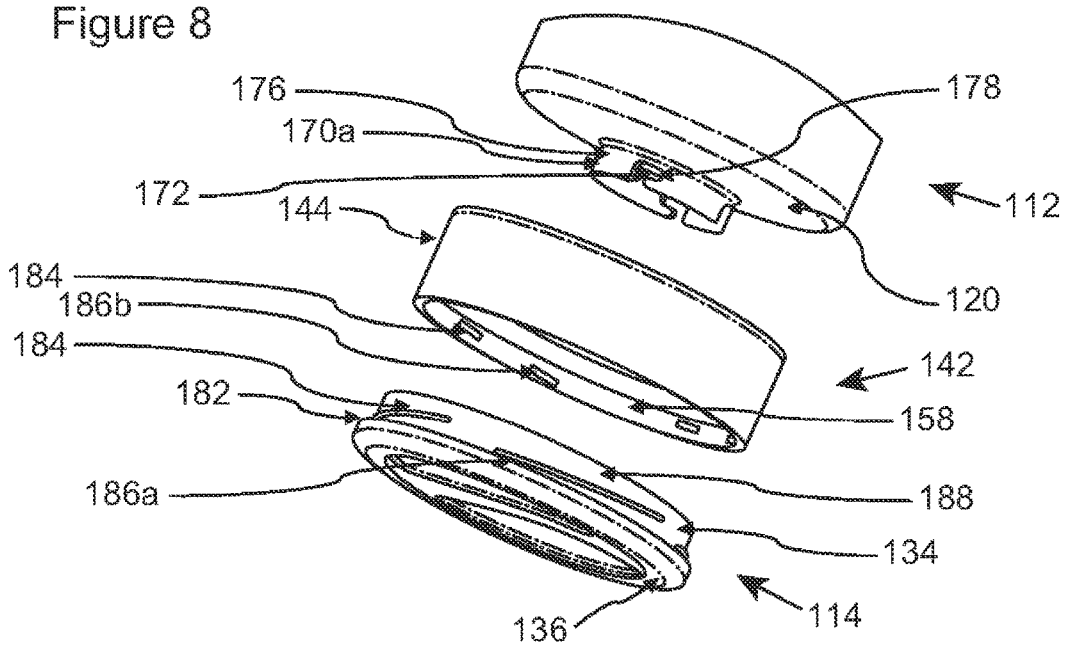
FIG. 8 shows an exploded assembly view of the base of the beverage container of FIG. 6.
Figure 9:
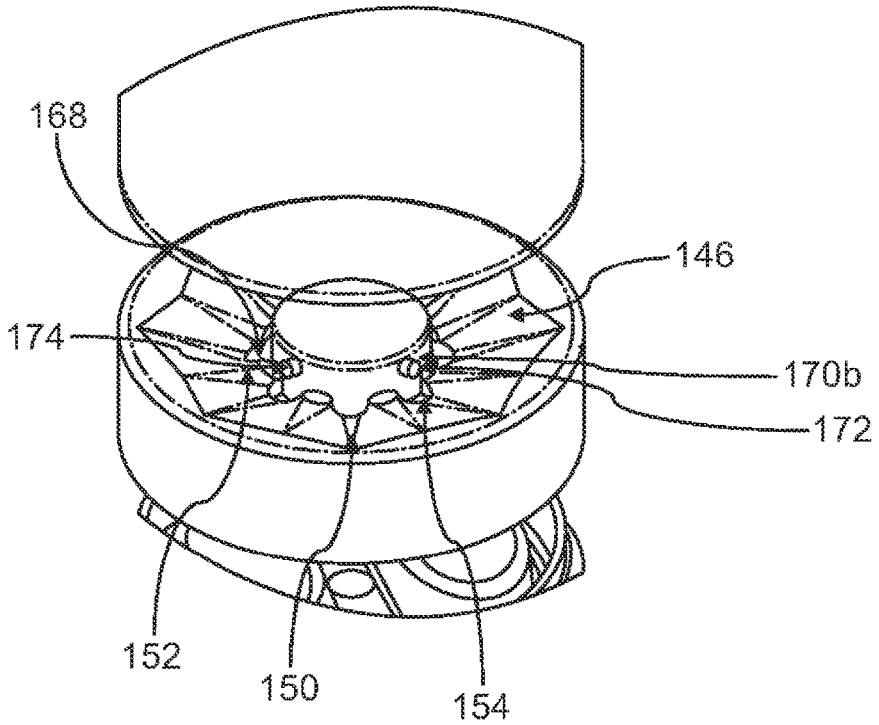
FIG. 9 shows an enlarged perspective view of the liquid collection device of the beverage container of FIG. 6.
Figure 10:
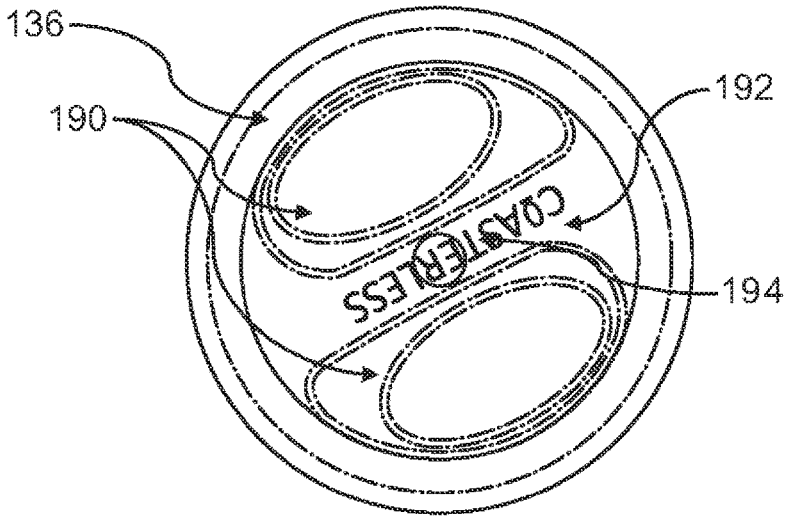
FIG. 10 shows a bottom view of the support portion of the beverage container of FIG. 6.

As part of the beverage container 10, there is also included a liquid collection device 42, shown separately in FIG. 5, which is formed from a resiliently flexible material such as silicone. The liquid collection device 42 comprises a cylindrical or frusto-conical side wall 44 and an annular upper surface 46 projecting radially inwardly from an upper edge 48 of the side wall 44.

The upper surface 46 of the liquid collection device 42 is preferably not flat, but depends inwardly towards the longitudinal cylinder axis. The upper surface 46 includes a plurality of flutes 50, the flutes 50 having a series of ridges 52 and grooves 54 thereby providing the upper surface 46 with a variety of gradients and thus predetermined radially-inwardly extending falls.

Towards a lower edge 56 of the side wall 44, on the inner surface 58 of the liquid collection device 42 is provided at least one protrusion 60 extending around the entire inner circumference of the liquid collection device 42. This forms a further part of the liquid-tight sealing means and is configured to releasably liquid-tightly engage with the or each rib or ridge **38*a***.

The support portion 14 can be inserted through a central aperture 62 of the annular upper surface 46 of the liquid collection device 42, due to the liquid collection device 42 being elastic. The liquid collection device 42 is thus positionable around the stem 16. The lower edge 56 of the liquid collection device 42 engages with the stepped portion 38 of the support portion 14 in a liquid-tight fitting manner, with the protrusion 60 of the liquid collection device 42 forming a watertight seal with the ribs or ridges **38*a* of the upright wall 64 of the stepped portion 38**.

The central aperture 62 of the liquid collection device 42 is smaller than the diameter of the support portion 14, allowing space for the depending upper surface 46 of the liquid collection device 42 to be positioned. This therefore can make inserting the support portion 14 through the central aperture 62 challenging. By providing the flutes 50 as part of the upper surface 46, the upper surface 46 can be easily buckled, flexed or expanded in a concertinaed manner, greatly facilitating insertion of the support portion 14 through the central aperture 62.

The inner surface 58 of the liquid collection device 42, the upper surface 32 of the support portion 14 and the external surface 30 of the stem 16 define a pseudo-torus, which acts as an excess liquid reservoir 66. The annular upper surface 46 of the liquid collection device 42 does not extend radially inwardly so far as to contact the external surface 30 of the stem 16, therefore an acceptance aperture 68 is defined between a radially innermost edge of the liquid collection device 42 and the stem 16, allowing moisture collected by the liquid collection device 42 or running down the external surface 28 of the container 10 to enter the excess liquid reservoir 66.

In use, the liquid collection device 42 is engaged with the support portion 14 so as to form the excess liquid reservoir 66 as previously described. The liquid receptacle portion 12 may then be filled with a beverage.

As condensation formation or spillages down the external surface 28 of the liquid receptacle portion 12 occur, liquid droplets will run along down the external surface 28 under gravity. When the droplets reach the join between the upstanding wall 18 and base 20 of the external surface 28, they will either fall, landing on the annular upper surface 46 of the liquid collection device 42, or will cling to the frusto-conically shaped portion of the external surface 28, running down the external surface 30 of the stem 16 and into the excess liquid reservoir 66.

The volume of the excess liquid reservoir 66 will depend on the relative size of the liquid collection device 42. Typical volumes may be of the order of 5 milliliters, which should be sufficient for small spillages expected over the course of a single fill of the liquid receptacle portion 12. However, if the excess liquid reservoir 66 is filled, there will clearly be a spillage.

The excess liquid reservoir 66 can be emptied by breaking the watertight seal of the reservoir 66 in an appropriate location, for instance, near a sink. This can be done by gently pulling on the liquid collection device 42 to release the contact between the protrusion 60 of the liquid collection device 42 and the rib or ridge 38*a* of the upright wall 64 of the stepped portion 38.

The danger with having an excess liquid reservoir 66 is that, when a person drinks from the beverage container 10, the stored liquid is spilt. However, in this instance, the dependence of the upper surface 46 of the liquid collection device 42 as it projects inwardly to provide an overhang means that the stored liquid is trapped within the excess liquid reservoir 66, even when the beverage container 10 is tilted. The angle of dependence of the upper surface 46 of the liquid collection device 42 is therefore designed to cope with normal tilt angles of the beverage container 10 as a beverage is being consumed by a user of at least 100° from the vertical.

It will be appreciated that beverage containers are widely manufactured in a variety of construction materials. Although the above embodiment is specified as being constructed substantially from glass or plastics, any resilient material could be utilised, as suggested previously.

The liquid receptacle portion, stem and support portion do not necessarily need to be formed integrally with one another. Although this is preferable in many regards, being easily manufactured, and is both watertight and stable, a container could be constructed so as to make insertion or attachment of the liquid collection device more straightforward.

In the present embodiment, the liquid collection device must be passed over the support portion in order to position in around the stem. The liquid collection device must be sufficiently rigid so as to form a water- or liquid-tight seal around the support portion when located, which means that attachment of the liquid collection device in the first instance can be challenging.

It is therefore possible to provide separable liquid receptacle and support portions, for example using a snap-fit or screw-fit stem to interconnect the two. Modularity can thus be readily envisaged.

Whilst flutes having a generally undulating profile are suggested for the annular upper surface of the liquid collection device, other designs could be provided for. The important feature is that the captured liquid is drained into the excess liquid reservoir, rather than down an external surface of the beverage container. Consequently, flutes, although advantageous in allowing expansion for location, could be replaced with sinusoidal corrugations, or simply a smooth dished, concave or frusto-conical portion.

Whilst the watertight seal of the excess liquid reservoir is provided by the contact between the protrusion of the liquid collection device and the upright wall of the stepped portion of the support portion, sealing could be provided in some other manner. For instance, there could be provided some interlocking mechanism between the liquid collection device and the support portion, such as a screw-thread.

Furthermore, the ribs or ridges of the upright wall of the stepped portion of the support portion may not be necessary, if a liquid-tight seal can be maintained between the protrusions of the liquid collection device and the upright wall.

It will also be appreciated that the excess liquid reservoir does not necessarily have to be formed when the liquid collection device is attached to the device; the reservoir could for instance be integral to the support portion. Such a design does make removal of the excess liquid more challenging, however.

Alternatively, the excess liquid reservoir could be solely defined by the liquid collection device, the liquid collection device having a lower surface and inner cylindrical surface to abut the upper surface of the support portion and external surface of the stem respectively. This would negate the requirement for a stepped portion of the support portion, as the liquid collection device could rest upon the upper surface of the support portion, and tightly fit against the stem to hold the liquid collection device in place along the longitudinal cylindrical axis. Since such a design would inhibit the ability to pass the support portion through the central aperture of the liquid collection device, such a design would be best used in combination with a modular beverage container as described above.

Additionally or alternatively, it is feasible that the liquid collection device could be integrally formed as one-piece with the support portion.

Referring now to FIGS. 6 to 10, a second embodiment of a beverage container 110 is shown. Similar or identical features of the second embodiment are identified by similar or identical reference numbers, and detailed description of these features is hereby omitted, for brevity.

The beverage container 110 comprises a liquid receptacle portion 112, defining a void or volume 124 therein, and a support portion 114, with a liquid collection device 142 interposed therebetween. A stem 116 interconnects the liquid collection device 142 and the liquid receptacle portion 112, and is hereby formed of two, releasably-interconnectable stem portions 170*a* and 170*b*. The first stem portion 170*a* extends downwards from a base 120 of the liquid receptacle portion 112 in a substantially tubular arrangement.

The liquid collection device 142 comprises a cylindrical side wall 144 and an annular upper surface 146 from which the second stem portion 170*b* extends in an upward direction. The upper surface 146 preferably has a downward slope in an inward direction and terminates at or adjacent to the second stem portion 170*b*. The second stem portion 170*b* is also preferably substantially tubular and sized to complementarily fit within the first stem portion 170*a*.

Stem connection means 172 are provided to secure the first and second stem portions 170*a*, 170*b* together. The second stem portion 170*b* includes a plurality of stem connectors 174 which protrude radially from a circumferential surface 176 of the second stem portion 170*b*. The stem connectors 174 are small cylindrical protrusions which are sized and positioned to fit within a series of connector slots 178 in the first connector portion 170*a*. Each connector slot 178 has a substantially L-shaped longitudinal extent or keyway. As such, a twist and lock detent or fastening mechanism is provided.

The shape of each connector slot 178 means that, in order to interconnect the two stem portions 170, the second stem portion 170*b* may first be positioned within the first stem portion 170*a*, engaging the stem connectors 174 with the connector slots 178, and the two stem portions 170 may then be rotated relative to each other. This will ensure that the stem connectors 174 lock within the connector slots 178, ensuring the two parts do not separate until reverse rotation is applied. An interlocking key and keyway arrangement is therefore provided.

A plurality of acceptance apertures 168 is provided around the circumference of the second stem portion 170*b*, in order to allow liquid to pass into the liquid collection device 142. Liquid is encouraged into the acceptance apertures 168 by the preferable provision of flutes 150 on the upper surface 146, which comprise a series of ridges 152 and grooves 154, as described previously.

The liquid collection device 142 further comprises a baffle 180, concentric to the side wall 144, which extends from the upper surface 146 towards the support portion 114. The baffle 180, together with the slope of the upper surface 146, provides protection against spillage of the contents of the liquid collection device 142 when the beverage container 110 is in use. The baffle 180, in this embodment, is preferably a uniformly continuous depending wall.

Whilst one baffle 180 is hereby described, a plurality of spaced-apart baffles may be utilised in order to provide protection against spillage. The baffles may be discontinuous and/or spaced radially apart. Furthermore, the baffles may be at different angles in order to prevent spillage at any desired degree of inversion of the beverage container.

The liquid collection device 142 is sealed by the connection of the support portion 114. The support portion 114 comprises a side portion 134 and base 136, the base 136 having a larger diameter than the side portion 134 so as to form an overhang 182.

The support portion 114 and liquid collection device 142 are releasably connected by way of a support connection means 184. This support connection means 184 comprises a plurality of first helical protrusions 186*a* disposed on an outer surface 188 of the side portion 134 of the support portion 114, and a plurality of second helical protrusions 186*b* disposed on an inner surface 158 of the liquid collection device 142. The support portion 114 can then be engaged within the liquid collection device 142 and rotated. The first and second helical protrusions 186*a*, 186*b* are configured such that relative rotation of the first and second helical protrusions 186*a*, 186*b* causes the support portion 114 to be drawn within the liquid collection device 142 until movement is restricted by the liquid collection device 142 contacting the overhang 182. The tight interconnection forms a watertight seal, thus keeping liquid within an excess liquid reservoir 166 formed by the combination of the support portion 114 and liquid collection device 142.

The beverage container 110 is designed such that, with the beverage container 110 in an upright orientation, the liquid is retained within the support portion 114 itself. However, it is clear that as more liquid is added, the support portion 114 will be filled and liquid will begin to contact the liquid collection device 142. It will be apparent to the skilled person that other configurations will be possible whereby the liquid is contained within the support portion 114, liquid collection device 142, or any other part of the device, in accordance with the invention.

The support portion 114 further comprises two depressions 190 within the base 136, which results in a gripping element 192 being formed. This gripping element 192 can then be utilised by the user in order to provide the twisting force required to connect and release the support portion 114 and the liquid collection device 142. This is required in order that the excess liquid reservoir 166 may be emptied swiftly and easily. A design 194 is formed on the gripping element 192, to enhance the marketing characteristics of the beverage container 110 and/or provide brand recognition.

Whilst the stem of the second embodiment has been described as having two stem portions, it may instead be formed in one portion or more than two portions. Furthermore, a stem portion need not be attached to the liquid collection device but could instead protrude from the support portion to attach directly to the stem portion of the liquid receptacle portion. Alternatively, three stem portions could be included, for instance, with one stem portion protruding from each of the liquid receptacle portion, liquid collection device, and support portion, and each stem portion being connected to at least one other stem portion. A greater or lesser number of stem portions could be utilised extending from one or more of the liquid receptacle portion, liquid collection device, and/or support portion.

Although a glass or tumbler has been described above, other kinds of beverage container can also be considered, such as a decanter, bottle and carafe with which the elastically flexible collector of the first embodiment can be utilised or with which the rigidly formed collector of the second embodiment can be utilised.

Although preferably flush with the liquid receptacle portion, the collection device and/or support portion may not be flush with the sides or edges of the liquid receptacle portion.

Additionally or alternatively, the container may be provided with a lid or cover, which may be screw-threaded or snap-fit. Other materials in addition to glass may be considered, such as plastics, pottery and/or ceramics.

It is therefore possible to provide a beverage container for preventing or limiting moisture collection on a lower surface or base of a beverage container by providing a liquid collection device for collecting excess liquid present on the external surface of the liquid receptacle portion. The provision of an excess liquid reservoir which is spaced apart from a liquid receptacle portion of the beverage container and which utilises wherein the liquid collection device to collect and retain excess runoff moisture, condensate and spillage is highly beneficial.

By use of the liquid collection device, captured liquid never reaches the lower surface of the beverage container, and therefore undesirable watermarking of furniture can be avoided. By providing the liquid collection device flush with the external surface of the standard liquid collection portion of the container, an attractive overall design can be achieved, whilst preventing egress of the collected runoff.

The words 'comprises/comprising' and the words 'having/including' when used herein with reference to the present invention are used to specify the presence of stated features, integers, steps or components, but does not preclude the presence of addition of one or more other features, integers, steps, components or groups thereof.

It is appreciated that certain features of the invention, which are, for clarity, described in the context of separate embodiments, may also be provided in combination in a single embodiment. Conversely, various features of this invention which are, for brevity, described in the context of a single embodiment, may also be provided separately or in any suitable sub-combination.

The embodiments described above are provided by way of examples only, and various other modifications will be apparent to persons skilled in the field without departed from the scope of the invention as herein described.

What is claimed is:

1. A beverage container adapted to prevent or inhibit moisture collection on a lower surface thereof the drinking container comprising:

a liquid receptacle portion having inner and external surfaces defined by at least one upstanding wall and a base;

a support portion disposed below the base of the liquid receptacle portion; and a liquid collection device interposed between the liquid receptacle portion and the support portion which in-use collects excess liquid present on the external surface of the liquid receptacle portion;

an upper surface of the liquid collection device being downwardly sloped in an inward direction which prevent or limit spillage during tilting of the beverage containers;

wherein the liquid receptacle portion is attached to the support portion by a stem;

wherein the liquid collection device is releasably attachable to the support portion of the beverage container, the excess liquid reservoir being formed by an inner surface of the liquid collection device, an upper surface of the support portion, and an outer surface of the stem; and wherein the liquid collection device includes an aperture adapted to allow the support portion to pass therethrough.

2. The beverage container as claimed in claim 1, wherein the liquid collection device defines at least in part an excess liquid reservoir into which exterior excess liquid is directable by the liquid collection device.

3. The beverage container as claimed in claim 1, wherein the liquid receptacle portion is defined by a single upstanding cylindrical wall and the base.

4. The beverage container as claimed in claim 1, wherein a lower region of the external surface of the liquid receptacle portion is at least in part frusto-conical or substantially frusto-conical.

5. The beverage container as claimed in claim 1, wherein the liquid receptacle portion, stem and support portion are integrally formed with one another.

6. The beverage container as claimed in claim 1, wherein the stem is releasably attachable to the support portion.

7. The beverage container as claimed in claim 1, wherein the support portion includes a stepped portion which engages with the liquid collection device.

8. The beverage container as claimed in claim 1, wherein the liquid collection device includes at least one sealing projection which forms a watertight seal for the excess liquid reservoir with the support portion.

9. The beverage container as claimed in claim 1, wherein the liquid collection device is elastic.

10. The beverage container as claimed in claim 1, wherein the upper surface of the liquid collection device includes at least one flute having a predetermined fall.

11. The beverage container as claimed in claim 1, wherein the upper surface of the liquid collection device includes at least one baffle extending towards the support portion which further prevents or limits spillage during tilting of the container.

12. The beverage container as claimed in claim 1, wherein the liquid receptacle portion and support portion have identical or substantially identical circumferential extents along a majority of their axial extents.

* * * * *